United States Patent [19]

Marsden et al.

[11] Patent Number: 4,692,358

[45] Date of Patent: Sep. 8, 1987

[54] APPARATUS AND METHOD FOR APPLYING MATERIAL TO ARTICLES

[75] Inventors: Peter Marsden, Harrow; Paul R. Bradwell, London, both of United Kingdom

[73] Assignee: Haden Drysys International Limited, London, United Kingdom

[21] Appl. No.: 803,408

[22] PCT Filed: Mar. 22, 1985

[86] PCT No.: PCT/GB85/00111

§ 371 Date: Nov. 21, 1985

§ 102(e) Date: Nov. 21, 1985

[87] PCT Pub. No.: WO85/04350

PCT Pub. Date: Oct. 10, 1985

[30] Foreign Application Priority Data

Mar. 23, 1984 [GB] United Kingdom ..... 8407650

[51] Int. Cl.[4] ..... B05B 7/12; B05D 1/02

[52] U.S. Cl. ..... 427/421; 118/314; 118/323; 901/43; 239/436; 239/444

[58] Field of Search ..... 118/314, 323; 901/43; 239/436, 444; 427/421

[56] References Cited

U.S. PATENT DOCUMENTS

| | | | |
|---|---|---|---|
| 3,834,621 | 9/1974 | Pacht et al. | 239/444 X |
| 3,840,179 | 10/1974 | Krohn et al. | 239/1 |
| 3,908,592 | 9/1975 | Ordway | 118/323 X |
| 3,971,512 | 7/1976 | Duncan | 239/444 X |
| 4,164,325 | 8/1979 | Watson | 239/252 |
| 4,228,958 | 10/1980 | Perry | 239/411 |
| 4,230,067 | 10/1980 | Iwamoto et al. | 118/104 |
| 4,239,431 | 12/1980 | Davini | 118/323 X |
| 4,357,900 | 11/1982 | Buschor | 118/323 X |

*Primary Examiner*—Shrive P. Beck

*Attorney, Agent, or Firm*—Niro, Scavone, Haller & Niro, Ltd.

[57] ABSTRACT

Two paint spray guns (2) are mounted on a common manifold block (14) by means of which trigger air, atomizing air and paint are fed to the guns. Each spray gun (2) is individually controlled by a respective solenoid valve (28) also supported on the manifold block. The apparatus is mounted on a robot arm (52) and is maneuvered thereby to undertake a painting operation. During each stage of the painting operation a selected one of the spray guns is positioned adjacent a surface to be painted and then operated to apply paint. The painting operation can be performed very quickly as the movements required of the robot are simpler and therefore faster than those of a conventional painting robot having just a single spray gun.

11 Claims, 7 Drawing Figures

APPARATUS AND METHOD FOR APPLYING MATERIAL TO ARTICLES

Figure 1:
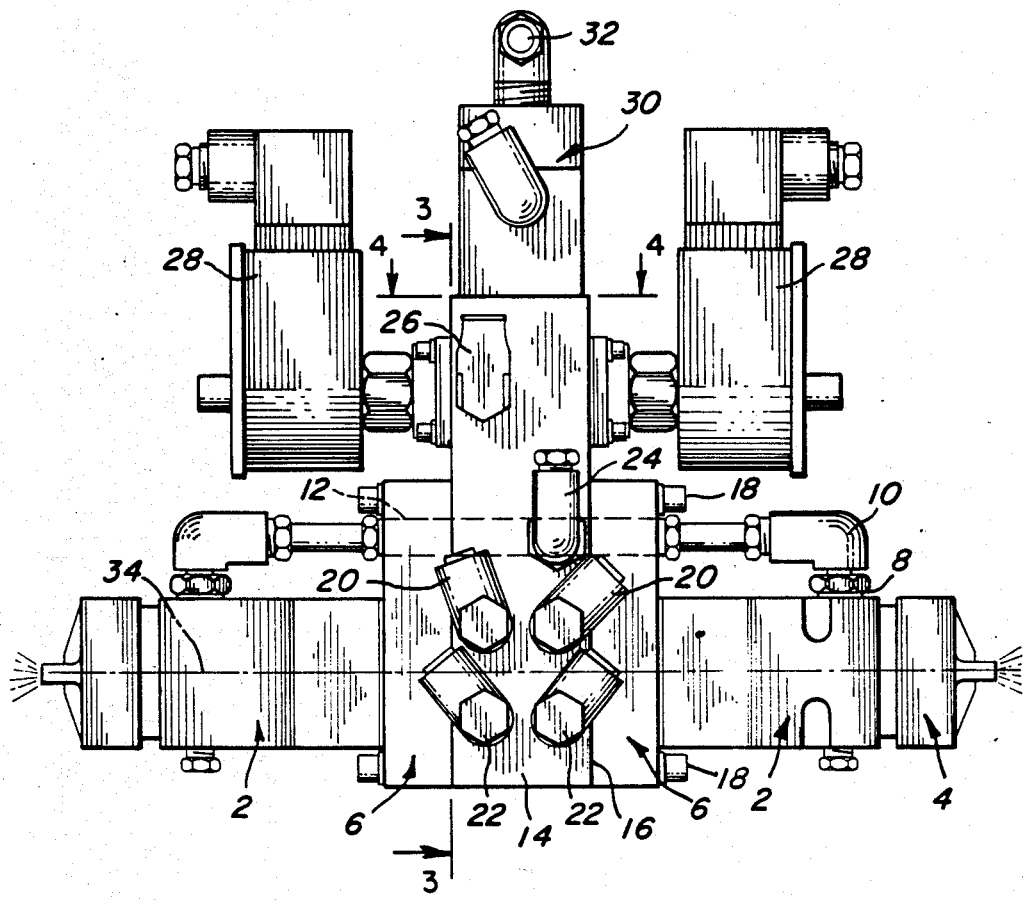

The present invention relates to apparatus and a method for applying material to articles.

It is known to spray paint automobile bodies and other articles in a paint spray booth using a paint spray gun carried by a robot or other automatic painting device. However, where the painting is to be done entirely by automatic devices, it has been found difficult to paint the automobile bodies or other articles at a fast enough rate.

In this respect, the paint spray gun must always be arranged adjacent to and facing the surface to be painted, and there is an optimum spacing. Thus, if the article to be painted has a complex surface, for example, as an automobile body, the robot needs to manoeuvre the paint spray gun to a number of different positions and the limitations in movement of the robot mean that some position changes can take an appreciable time to accomplish. The situation is aggravated because the paint spray gun may be working in a confined space, for example in the engine compartment or within the door opening of an automobile body. Sometimes it is even necessary to withdraw the paint spray gun from the confined space, manoeuvre it into the necessary position for the next painting operation and then return it into the confined space.

According to a first aspect of the present invention there is provided apparatus for applying material to articles, said apparatus comprising two applicators each having an applicator nozzle, the applicators being mounted on a common manifold block, wherein the manifold block has bores extending therethrough arranged to communicate inlet ports on the manifold block (14) with the applicators.

Preferably, the applicators are removably mounted on the manifold block. In an embodiment, the manifold block has two or more mounting surfaces, in each of which respective bores terminate. Each applicator has a base member with a corresponding mounting surface. Each applicator can be mounted on the manifold block by way of its base member such that the corresponding mounting surfaces are in abutment.

Respective control means for each applicator are supported on the manifold block.

Preferably, each applicator is switched on and off by way of fluid pressure applied by control means, for example, comprising a solenoid valve. Generally, each solenoid valve will be arranged to control the supply of trigger air to a respective applicator.

Preferably, a dump valve is arranged to control the communication of paint bores within the manifold block with an outlet for paint. The dump valve may be incorporated into the manifold block or it may be a separate unit supported on the manifold block.

In an embodiment, two of said applicators are mounted on the block and are arranged such that their longitudinal axes subtend an angle in the range 90° to 180°. Where the angle is 180°, the longitudinal axes coincide but the nozzles face in opposite directions.

Preferably, each of said applicators is an applicator gun, for example, a spray gun.

The present invention also extends to an automatic painting apparatus having at least one articulated arm at the free end of which two or more paint applicators, each having an applicator nozzle, are mounted such that said nozzles face in different directions.

The present invention also extends to a method of applying material to a plurality of surface areas using an arrangement of applicator nozzles facing in different directions, the method comprising the steps of moving the arrangement such that one of the nozzles is facing a first surface area, applying material through said one nozzle onto said first surface area, terminating application of the material through said one nozzle, and moving the arrangement such that a selected one of the nozzles is facing a further surface area, and applying material through said selected nozzle onto said further surface area.

The selected nozzle may be said one nozzle or another of said nozzles. The nozzle is selected such that the movement to be performed by said arrangement is kept simple, and/or such that the application time as compared to the time during which application of the material is terminated is maximised.

Preferably, each of said nozzles is provided on an applicator, the applicators being mounted on a robot arm or other automatic device for moving the applicators and hence the arrangement of nozzles.

Generally, the applicator and thus its nozzle is moved relative to the article to be coated whilst coating material is sprayed therethrough.

In one embodiment, each applicator is a spray gun.

The present invention also extends to a method of applying a material to a surface area using an arrangement of two or more applicators having nozzles which face in different directions, the method comprising the steps of moving the arrangement such that the nozzle of a selected one of the guns is facing the surface area and operating said one applicator whilst sweeping the arrangement over said surface area such that the time during which an applicator is operational as compared to the time during which no applicator is operational for the application step is kept high.

In an embodiment, said applicator is selected such that the number of component movements and/or the time necessary to position its nozzle facing the surface area is minimized.

The arrangement may be mounted on a robot or other automatic device which is arranged to move said applicator arrangement.

Preferably, an apparatus as defined above is used to perform the method of the present invention.

Figure 2:
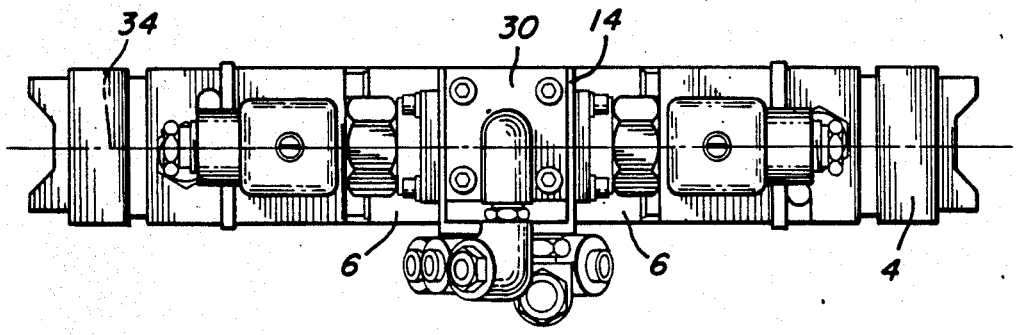
Figure 3:
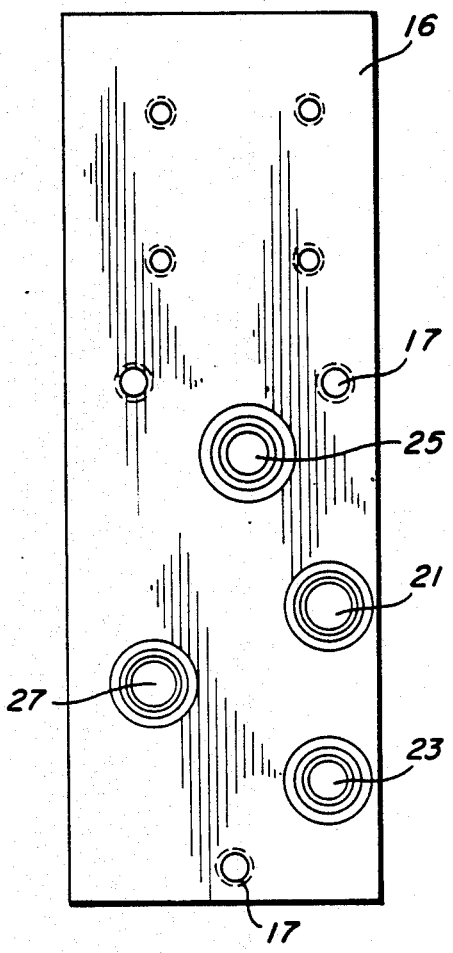
Figure 4:
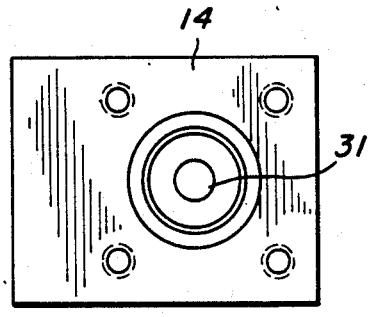

Embodiments of the present invention will hereinafter be described with reference to the accompanying drawings, in which:

FIG. 1 shows an elevation of an opposed spray gun arrangement for use on a robot or other automatic painting device, FIG. 2 shows a plan view from above of the spray gun arrangement of FIG. 1, FIG. 3 is a view taken along the line 3—3 of FIG. 1 showing the mounting surface of a manifold block of the spray gun arrangement, FIG. 4 shows the top surface of the manifold block taken along the line 4—4 of FIG. 1, and FIGS. 5*a*, 5*b* and 5*c* show successive stages in the spray painting of an automobile body using an opposed spray gun arrangement of the present invention.

The opposed spray gun arrangement shown in the drawings includes two substantially conventional paint spray guns 2 each having a respective nozzle 4. In known manner, the nozzle of each spray gun is open or shut by a piston controlled needle (not shown) which is normally biased in the closed position. The nozzle is opened by applying trigger air to the spray gun to move the piston.

When the nozzle is open, paint supplied to the gun is sprayed therethrough by way of atomising air which is also supplied to the gun. Each of the guns 2 is arranged to be connected to two sources of atomising air, both of which sources may be adjustable. If air from one source only is fed to the opened nozzle the paint spray will have a narrow fan width whereas if air from both supplies is fed to the nozzle the paint spray will have a wide fan width.

In the arrangement illustrated in the drawings each spray gun 2 is mounted on a base 6. Each gun 2 can be removably or permanently fixed to its base 6, and indeed it could be integrally formed therewith. Each base 6 has a number of bores (not shown) extending therethrough, each bore communicating with a respective one of the bores (not shown) provided in the corresponding spray gun 2 for the atomising air supplies and for the trigger air supply. An internal bore (not shown) of the gun 2 by means of which paint is fed to the nozzle 4 communicates with an inlet port 8 for paint on the gun. A tubular coupling 10 communicates this inlet port 8 with a bore indicated at 12 extending through the gun base 6.

Each spray gun 2 is supported on a manifold block 14. In this respect, a planar mounted surface on each base 6 abuts a corresponding mounting surface 16 on the manifold block 14. Screwthreaded bolts, as 18, extend through the base 6 into the manifold block 14 to hold the respective gun in position. The bolts 18 are received in threaded bores 17 (FIG. 3).

Of course, alternative mounting means can be employed. For example, thread studs extending from the manifold block 14 could be used, each gun base 6 being secured to the respective studs by nuts.

The bores in each gun base 6, and hence the corresponding bores in the respective gun 2, are arranged to communicate with respective bores provided in the manifold 14 so that paint, trigger air and atomising air can be fed to each of the guns 2 by way of the manifold block 14. Thus, the first and second supplies of atomising air for each gun 2 are coupled to the manifold block by way of respective couplings 20 and 22 and thence by way of bores 21 and 23 in the block 14 through the base 6 to the associated gun 2. Similarly, paint is fed into the manifold block 14 by way of a coupling 24 which communicates with a bore 25 aligned with the bores 12 in both bases 6. Hence, the paint supplied to the coupling 24 can be fed to either or both of the guns 2. Air for triggering the guns by opening the nozzles is fed into the manifold block 14 by way of a coupling 26. A respective bore 27 for each gun 2 extends through the manifold block 14 and is arranged to communicate the associated gun 2 with the coupling 26 for trigger air by way of the base 6 of that gun. A respective electrically controlled solenoid valve 28 is associated with each gun 2 and is carried on the manifold block 14. Each solenoid valve 28 is arranged to close and open the bore 27 communicating with the associated spray gun. Normally, when the solenoid valve is not energised, the bore 27 is closed.

However, when the solenoid valve 28 is energised by the application of an electrical signal it opens the respective bore 27 such that trigger air supplied at coupling 26 is communicated to the respective gun 2 to open the nozzle and thus initiate paint spraying by the gun.

The manifold block 14 also carries a dump valve 30 which controls communication between an axially extending bore 31 in the manifold block 14 and the coupling 24 and the bores 25 and 12 for the paint. By means of the dump valve 30, paint in the coupling 24 and in the couplings 10 to the guns can be quickly discharged through exit port 32.

In the embodiment illustrated, the dump valve 30 is supported on the manifold block 14. Alternatively, the dump valve could be built in or incorporated into the manifold block.

It will be appreciated that if it is necessary to remove a gun 2 for any reason, for example, because of a blockage, this can be easily and quickly achieved by simply removing the gun 2 and its base 6 from the manifold block and fixing the base 6 of a replacement gun in position on the manifold block 14 by way of the bolts 18. No coupling or uncoupling of air or paint lines is necessary.

The solenoid valves 28 are each mounted on the manifold block 14 in close physical proximity to the respective gun 2. This ensures that each gun has a fast response to the electrical signals fed to the solenoid valve to initiate opening or closing of the nozzle.

If required, the solenoid valves 28 could be mounted a short distance from the manifold block 14.

Similarly, the positioning of the dump valve at the manifold block close to the guns ensures that colour changing can be done in the minimum of time and with a minimum of paint and solvent loss.

The compact spray gun arrangement illustrated is intended to be mounted on a robot or other automatic painting device. Generally, the program of the robot will not only control the orientation of the gun arrangement but will also control the operation of the solenoid valves 28 and the supply of atomising air by way of the couplings 20 and 22.

Because the gun arrangement is compact it can be kept within the necessary weight limits for optimum use with most robots.

In the embodiment illustrated it will be seen that the longitudinal axes of the two guns 2 are spaced by 180°, that is, that the axes of the guns extend along a common longitudinal axis 34, with the nozzles 4 facing in opposite directions. It has been found that this can considerably decrease the time needed to paint a complex surface. Furthermore, it enables complex surfaces in confined spaces to be efficiently painted. It is estimated that using the gun arrangement illustrated, conventional robots will be able, for example, to paint 50 automobile bodies an hour. Such speeds are not possible with the automatic painting arrangements currently available.

Conventionally, a painting robot has several articulated arms and a paint spray gun is fixed to the free end of one arm by way of an articulation, akin to a wrist. In order to paint all the surfaces of an automobile body the arm and spray gun must be manipulated first of all to position the gun facing the surface to be painted at a predetermined spacing and then to move the nozzle along the surface. Thereafter the arm and gun have to be manipulated to correctly position the nozzle relative to the next surface to be painted. Some of the movements required by the robot arms and wrist articulation are complex and may take a long time to perform. Furthermore, where the robot is, for example, painting the edges of a door opening, the space may be confined and some movements thereof may be impossible.

Figure 5A:
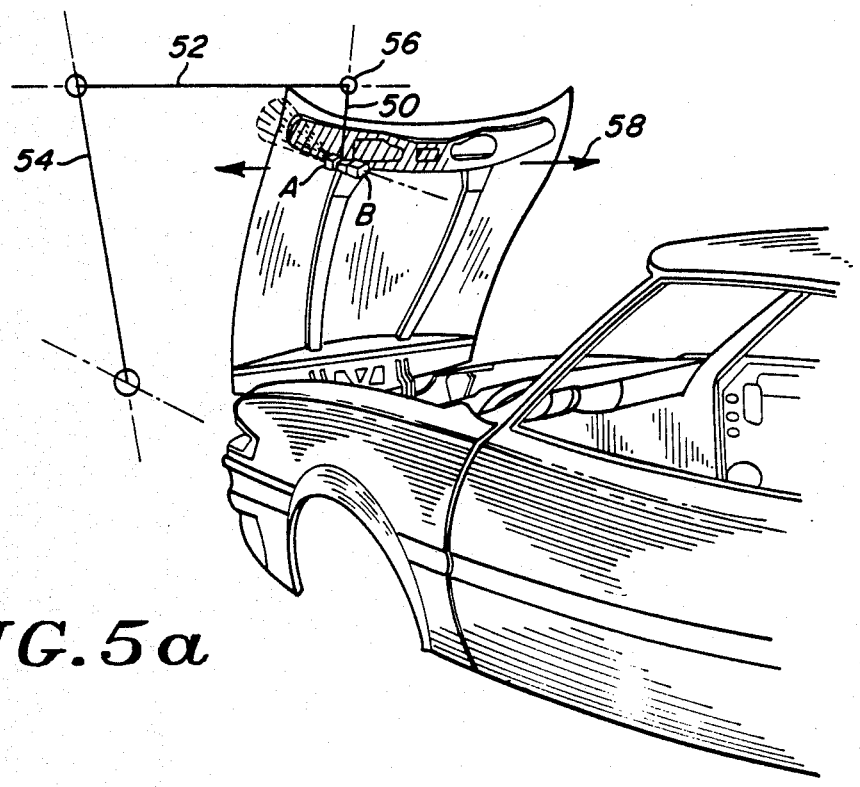
Figure 5B:
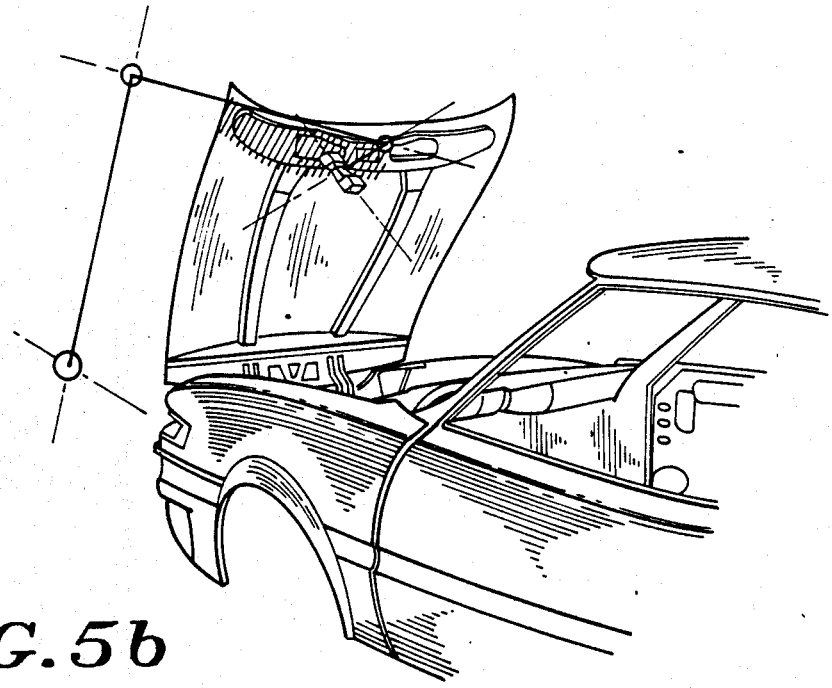
Figure 5C:
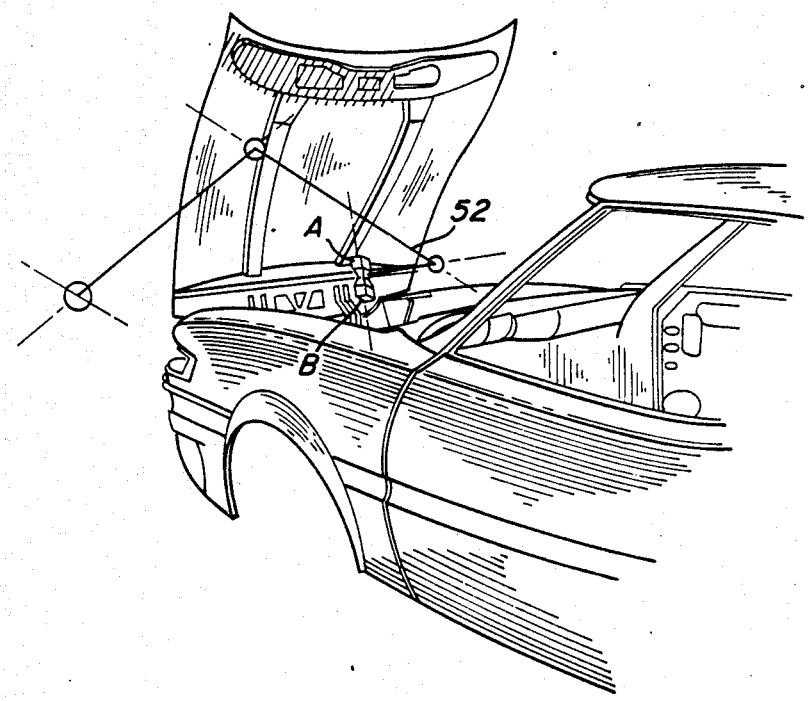

The advantage to be gained from the present invention is clearly shown in FIGS. 5*a* to 5*c* which show consecutive stages in the painting of a small area of a car body.

In FIGS. 5*a* to 5*c* the spray gun arrangement is shown for clarity simply by way of a line 50 indicating the position of the manifold block and by way of the two opposed guns A and B. The robot is represented to have two articulated arms 52 and 54, the gun arrangement being carried at the free end of arm 52 by way of an articulation 56.

In FIG. 5*a* the robot is positioned such that gun A is facing and spaced from the underside of the edge of a car bonnet. It will be appreciated that a sweeping motion of the gun arrangement as indicated by the arrow 58 whilst the gun A is operated will paint the region of the bonnet edge shown in shading. It will also be seen that during this operation the longitudinal axis of the guns A and B is substantially horizontal.

If, when the shaded area of the bonnet edge has been painted it is required to paint a part of the engine compartment, the gun A is switched off and the robot positions the gun arrangement such that the common longitudinal axis of the guns is at approximately 45° to the horizontal. This position is shown in FIG. 5*b*. The robot then moves the gun arrangement down towards the engine compartment, rotating the axis of the guns through a further 30° such that the second gun B is now facing and spaced from the edge of the engine compartment to be painted. This is the position illustrated in FIG. 5*c*. The gun B is then operated and the robot appropriately sweeps the gun arrangement over the surface.

If the painting sequence illustrated in FIGS. 5*a* to 5*c* were done in a conventional manner by a single gun the robot would need to rotate the gun axis through 150° as it moved the gun from the bonnet edge to the engine compartment. In view of the contraints imposed upon movement of the gun by the construction of the robot and because the robot is within a space confined by both the bonnet and the engine compartment, performance of this painting schedule with a single gun would be very much slower. In fact, it is estimated that the use of the present spray gun arrangement increases the speed of the illustrated painting manoeuvre by about 5 times.

In the painting manoeuvre illustrated, the guns A and B are used alternately. In fact, it is not envisaged that the two guns would be used simultaneously, but that the gun most easily positionable facing each surface area to be painted would be used.

In the embodiment illustrated the guns have their longitudinal axes displaced by 180°. Although this is particularly preferred, the invention is not limited to this embodiment. For example, three guns could be mounted on a suitable manifold block 14 with their axes spaced 120° apart, or two guns could be used with their axes at any angle, for example, 90°, to each other.

In the embodiment described and illustrated, paint is applied to an automobile body by way of a spray gun. Clearly the invention is not limited to the spray painting of automobile bodies, and it extends to the application of other materials onto any article. For example, the materials to be applied include varnishes, lacquers, oils, waxes, undersealing compounds, powders and the like. Furthermore, the applicator need not be powered by air as is described above. Thus, the applicator may be air assisted, airless, electrostatic, or may be operated by a combination of these and/or other power means. Basically, the applicator comprises a nozzle to which material to be applied by the applicator is fed.

I claim:

1. A method of applying material to a plurality of surface areas using an arrangement of plurality of applicator nozzles mounted in fixed relation to a common manifold, wherein said nozzle have fluid outlets, all of which face in different directions, the method comprising the steps of orienting said manifold such that a first one of said nozzle outlets is facing in a first direction toward a first surface area, applying material through said manifold and said nozzle onto said first surface area, terminating application of the material through said first nozzle, and then moving the manifold as necessary to orient a second one of said nozzles to face a further surface area in a direction substantially angularly displaced from the first direction, and applying material through said manifold and said second nozzle onto said further surface area.

2. A method according to claim 1 wherein, if the manifold is reoriented from said first location to said second location, the change in the angular orientation of the manifold is less than the angle between the nozzle outlets.

3. A method of applying material to a plurality of spaced surface areas using a material applying apparatus which includes a plurality of applicator nozzles, said nozzles all facing in different directions, the method comprising the steps of:

moving said apparatus to a first location proximate a first one of said spaced surface areas;

orienting said apparatus such that a first one of said nozzles is facing said first surface area;

applying material through said nozzle onto said first surface area; and terminating application of the material through said first nozzle; and thereafter, moving the apparatus from the first location to a second location proximate to a second one of said spaced surface areas;

orienting such apparatus that a second one of said nozzles is facing said second surface area; and applying material through said second nozzle onto said second surface area.

4. A method according to claim 3 wherein, as the apparatus moves from said first location to said second location, the change in the orientation of the apparatus is minimized.

5. An automatic painting apparatus comprising at least one articulated arm having a free end, a manifold block being mounted on said free end, said manifold block carrying two or more applicators, each applicator having an applicator nozzle and being mounted on said manifold block such that all said nozzles face in different directions, the apparatus further comprising control means for the applicators, the control means being arranged to trigger each of said applicators individually.

6. An automatic painting apparatus according to claim 5, further comprising means for feeding paint to each of said applicators, and means for individually controlling the flow rate of paint from each of said applicators.

7. Apparatus for applying material to articles, said apparatus comprising a manifold block (14) having two or more mounting surfaces (16), a plurality of bores (21,23,25,27,31) extending through said manifold block

(14) and terminating in said mounting surfaces (16), two or more material applicators (2; A,B), each said applicator having an applicator nozzle (4) and a base member (6) defining an applicator mounting surface, wherein each said applicator is directly mounted on said manifold block such that the whole area of its applicator mounting surface is in abutment with a respective mounting surface (16) of the manifold block, and such that the bores of the manifold block which terminate in each said mounting surface are in communication with the respective applicator, each said applicator (2) facing in a direction which is different from the direction in which each other applicator faces and being arranged to be switched on and off by way of fluid pressure, and the apparatus further comprising a respective individual control means (28) for each said applicator, each said control means (28) being arranged to individually control the supply of fluid pressure to its respective applicator whereby each one of said applicators can be switched on and off by its individual control means independently of the condition of any of the other applicators and of the orientation of the apparatus.

8. Apparatus according to claim 7, wherein each said control means (28) is supported on said manifold block.

9. Apparatus according to claim 7, wherein each of said applicator (2; A, B) is removably mounted on the respective mounting surface of said manifold block (14).

10. Apparatus according to claim 7, wherein said applicators (2; A, B) are mounted on the manifold block such that the nozzles (4) of the applicators all face in different directions.

11. Apparatus according to claim 7, wherein two applicators (2) are mounted on the manifold block (14) and are arranged such that their longitudinal axes subtend an angle in the range 90° to 180°.

* * * * *